US010294725B2

(12) United States Patent
Bhosle

(10) Patent No.: US 10,294,725 B2
(45) Date of Patent: May 21, 2019

(54) STEERABLE ROTARY DRILLING DEVICES INCORPORATING A TILTED DRIVE SHAFT

(71) Applicant: Halliburton Energy Services, Inc., Houston, TX (US)

(72) Inventor: Gopal Madhukar Bhosle, Wetaskiwin (CA)

(73) Assignee: Halliburton Energy Services, Inc., Houston, TX (US)

( * ) Notice: Subject to any disclaimer, the term of this patent is extended or adjusted under 35 U.S.C. 154(b) by 249 days.

(21) Appl. No.: 15/105,168

(22) PCT Filed: Mar. 12, 2014

(86) PCT No.: PCT/US2014/024008
§ 371 (c)(1),
(2) Date: Jun. 16, 2016

(87) PCT Pub. No.: WO2015/137934
PCT Pub. Date: Sep. 17, 2015

(65) Prior Publication Data

US 2016/0319601 A1 Nov. 3, 2016

(51) Int. Cl.
*E21B 7/04* (2006.01)
*E21B 7/06* (2006.01)
(Continued)

(52) U.S. Cl.
CPC ..... *E21B 7/067* (2013.01); *E21B 4/003* (2013.01); *E21B 4/16* (2013.01); *E21B 7/062* (2013.01);
(Continued)

(58) Field of Classification Search
CPC ... E21B 7/04; E21B 7/06; E21B 7/067; E21B 7/062; E21B 44/005; E21B 4/003; E21B 4/16; E21B 17/04; E21B 47/12
See application file for complete search history.

(56) References Cited

U.S. PATENT DOCUMENTS 4,465,147 A 8/1984 Feenstra et al.
4,807,708 A 2/1989 Forrest et al.
(Continued)

FOREIGN PATENT DOCUMENTS

WO 2015137934 A1 9/2015

OTHER PUBLICATIONS

International Search Report and Written Opinion for PCT/US2014/024008 dated Dec. 5, 2014.

*Primary Examiner* — George S Gray
(74) *Attorney, Agent, or Firm* — Alan Bryson; C. Tumey Law Group PLLC

(57) ABSTRACT

A directional drilling sub comprises a housing, a coupling mechanism arranged within the housing, and a tilt drive shaft extending within the housing and has a first end coupled to the coupling mechanism and a second end coupled to a drill bit. The sub further comprises an upper eccentric assembly arranged within the housing to support the tilt drive shaft at the first end which includes an upper inner eccentric ring nested within an upper outer eccentric ring and a lower eccentric assembly arranged within the housing to support the tilt drive shaft at the second end which includes a lower inner eccentric ring nested within a lower outer eccentric ring, wherein rotational movement of at least one of the upper and lower inner or outer eccentric rings tilts the tilt drive shaft within the housing and thereby alters an azimuthal tool face orientation of the drill bit.

21 Claims, 5 Drawing Sheets

(51) Int. Cl.

| | |
|---|---|
| ***E21B 44/00*** | (2006.01) |
| ***E21B 47/12*** | (2012.01) |
| ***E21B 4/00*** | (2006.01) |
| ***E21B 4/16*** | (2006.01) |
| ***E21B 17/04*** | (2006.01) |

(52) U.S. Cl.
CPC ..... *E21B 17/04* (2013.01); *E21B 44/005* (2013.01); *E21B 47/12* (2013.01)

(56) References Cited

U.S. PATENT DOCUMENTS

| | | | | |
|---|---|---|---|---|
| 4,938,297 | A | 7/1990 | Schmidt et al. | |
| 5,307,885 | A * | 5/1994 | Kuwana | E21B 7/062 175/106 |
| 5,353,884 | A * | 10/1994 | Misawa | E21B 7/062 175/26 |
| 5,875,859 | A | 3/1999 | Ikeda et al. | |
| 5,979,570 | A | 11/1999 | McLoughlin et al. | |
| 6,340,063 | B1 | 1/2002 | Comeau et al. | |
| 6,415,878 | B1 | 7/2002 | Cargill et al. | |
| 6,808,027 | B2 | 10/2004 | McLoughlin et al. | |
| 7,467,673 | B2 | 12/2008 | Earles et al. | |
| 7,588,082 | B2 | 9/2009 | Lasater | |
| 2002/0166701 | A1* | 11/2002 | Comeau | E21B 4/02 175/61 |
| 2008/0190665 | A1* | 8/2008 | Earles | E21B 7/06 175/24 |
| 2012/0285746 | A1 | 11/2012 | Kvalvik | |

* cited by examiner

STEERABLE ROTARY DRILLING DEVICES INCORPORATING A TILTED DRIVE SHAFT

BACKGROUND

The present disclosure relates to directional drilling systems and techniques.

Directional drilling involves controllably varying the direction of a drilling system while drilling a well. Directional drilling can be used to reach or maintain a position within a target subterranean destination or formation with the drilling string. For instance, the drilling direction may be continuously controlled and adjusted to reach a target destination, to guide the drilling of a horizontally-drilled wellbore along a desired "pay zone," to correct for unwanted or undesired deviations from a desired or predetermined drilling path, or to avoid undesirable structures, such as bed rocks or water reservoirs. Using directional drilling, continuous adjustments may also be made to the wellbore trajectory, either to accommodate a planned change in direction or to compensate for unintended or unwanted deviation from the desired path, due to such factors as the varying characteristics of the formation, the makeup of the drilling assembly that is drilling the wellbore, and the drilling method employed.

One directional drilling technique involves the use of a downhole motor having a bent motor housing. The drill bit may be rotated either solely by the downhole motor, or by rotation of the entire drill string from the surface. When the entire drill string is rotated from the surface, the bent housing rotates along with the bit, to drill a nominally straight wellbore section. To deviate from the present direction, rotation of the drill string from the surface is ceased, so that the bent motor housing is generally non-rotating relative to the borehole. The drill bit is then rotated only using the downhole motor, to drill at a deviated angle determined by the angle of the bent motor housing. This is often referred to as "sliding drilling," as the non-rotating drilling string slides while the drill bit advances to drill the wellbore using only the power of the downhole mud motor.

Another directional drilling technique involves the use of a rotary steerable drilling system that controls an azimuthal direction and/or degree of deflection while the entire drill string is rotated continuously. Rotary steerable drilling systems typically involve the use of an actuation mechanism that helps the drill bit deviate from the current path using either a "point the bit" or "push the bit" mechanism. In a "point the bit" system, the actuation mechanism deflects and orients the drill bit to a desired position by bending the drill bit drive shaft within the body of the rotary steerable assembly. As a result, the drill bit tilts and deviates with respect to the borehole axis. In a "push the bit" system, the actuation mechanism is used to instead push the drill string against the wall of the borehole, thereby offsetting the drill bit with respect to the borehole axis. While drilling a straight section, the actuation mechanism remains disengaged so that there is generally no pushing against the formation. As a result, the drill string proceeds generally concentric to the borehole axis. Yet another directional drilling technique, generally referred to as the "push to point," encompasses a combination of the "point the bit" and "push the bit" methods.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to directional drilling systems and techniques.

Disclosed are directional drilling devices that include a tilt drive shaft. Use of a tilt or tiltable drive shaft rather than a bent drive shaft allows the drilling device to alter the azimuthal tool face orientation of an associated drill bit. Since the tilt drive shaft is tilted and not bent during operation, fewer mechanical stresses are assumed by the tilt drive shaft, which may make it possible to use a smaller drive shaft and thereby save on costs associated with inventory, machining, and repair. Moreover, a higher bit-to-bend angle can be achieved due to the resulting shorter distance between the bit and the focal point of the tilt drive shaft, thereby increasing the dogleg capability of the rotary steerable.

Axially offset upper and lower eccentric assemblies may be used to tilt the tilt drive shaft. Each eccentric assembly includes inner and outer nested eccentric rings, where each inner eccentric ring is coupled with an inner sleeve that extends therebetween, and each outer eccentric ring is coupled with an outer sleeve that extends therebetween. Accordingly, rotation of one eccentric ring in one of the eccentric assemblies correspondingly rotates the associated eccentric ring of the other eccentric assembly.

Figure 1:
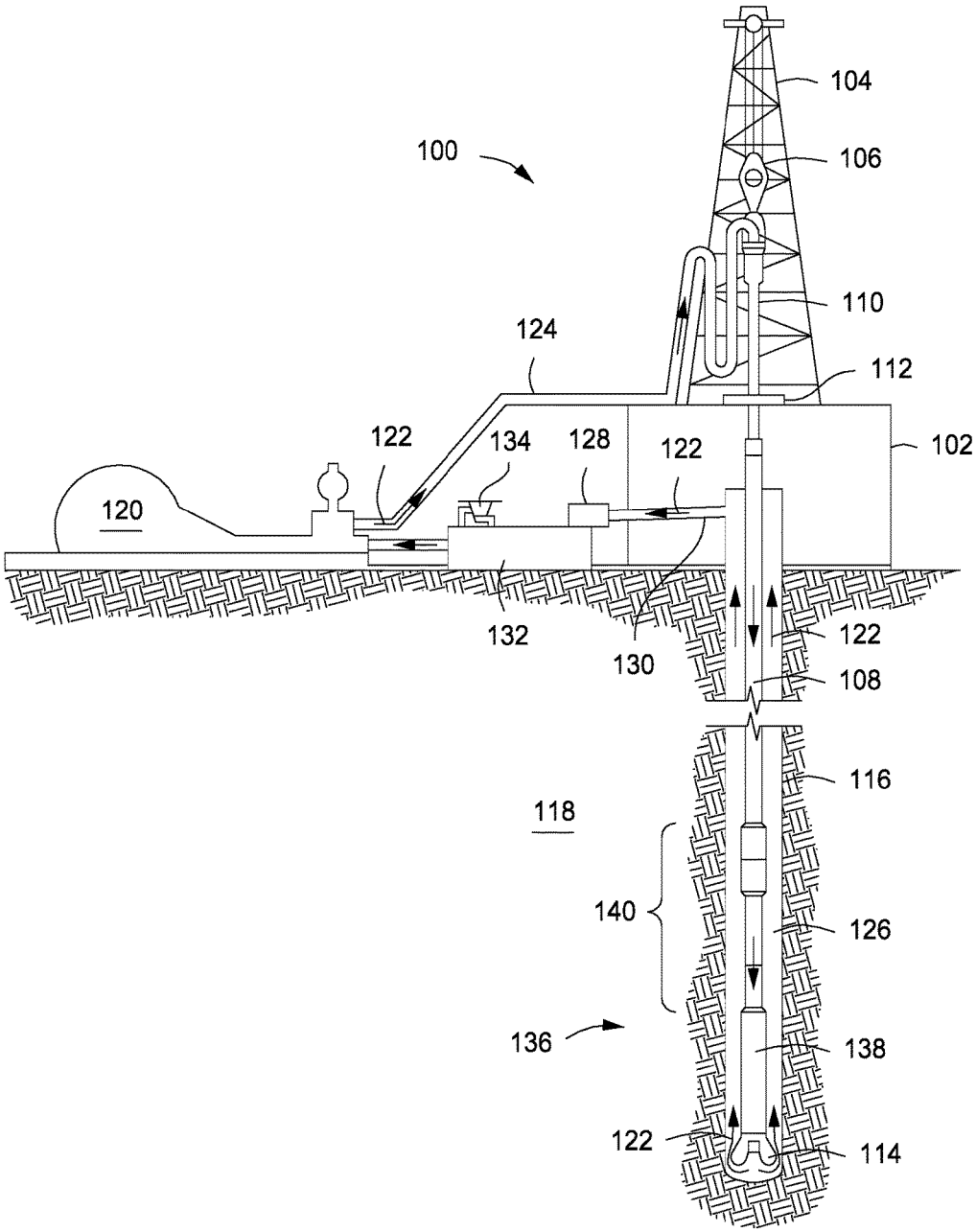
FIG. 1 illustrates an exemplary drilling system that may employ the principles of the present disclosure.

Referring to FIG. 1, illustrated is an exemplary drilling system 100 that may employ the principles of the present disclosure. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling system 100 may include a drilling platform 102 that supports a derrick 104 having a traveling block 106 for raising and lowering a drill string 108. The drill string 108 may include, but is not limited to, drill pipe or coiled tubing, as generally known to those skilled in the art. A kelly 110 (or top drive system) supports the drill string 108 as it is lowered through a rotary table 112. A drill bit 114 is attached to the distal end of the drill string 108 and rotated to create a borehole 116 that penetrates various subterranean formations 118.

A pump 120 (e.g., a mud pump) circulates drilling fluid 122 through a feed pipe 124 and to the kelly 110, which conveys the drilling fluid 122 downhole through the interior of the drill string 108 and eventually out through one or more orifices in the drill bit 114. The drilling fluid 122 is then circulated back to the surface via an annulus 126 defined between the drill string 108 and the walls of the borehole 116. At the surface, the recirculated or spent drilling fluid 122 exits the annulus 126 and may be conveyed to one or more fluid processing unit(s) 128 via an interconnecting flow line 130. After passing through the fluid processing unit(s) 128, a "cleaned" drilling fluid 122 is deposited into a nearby retention pit 132 (i.e., a mud pit). One or more chemicals, fluids, or additives may be added to the drilling fluid 122 via a mixing hopper 134 communicably coupled to or otherwise in fluid communication with the retention pit 132.

As illustrated, the drilling system 100 may further include a bottom hole assembly (BHA) 136 arranged at or near the distal end of the drill string 108. The BHA 136 may include the drill bit 114, but may also include a directional drilling sub 138 operatively coupled to the drill bit 114, and a measure-while-drilling (MWD) tool 140 operatively and communicably coupled to the directional drilling sub 138. In some embodiments, the directional drilling sub 138 may include a downhole drilling motor or mud motor used to power and otherwise rotate the drill bit 114 during drilling operations. The MWD tool 140 may include any of a number of known sensors, devices, and/or gauges used to help a driller or well operator optimize drilling operations. For instance, the MWD tool 140 may include pressure and temperature sensors, formation evaluation sensors, directional sensors, and/or logging-while-drilling tools. These sensors are well known in the art and are not described further.

As described below, the directional drilling sub 138 may include a drive shaft that is operatively coupled to and otherwise configured to rotate the drill bit 114. According to certain embodiments of the present disclosure, the directional drilling sub 138 may be configured to tilt the drive shaft to alter the tool face direction of the drill bit 114 and thereby modify the wellbore trajectory. As will be appreciated, tilting instead of bending the drive shaft may result in lower mechanical stresses assumed by the drive shaft, which may make it possible to use a smaller (i.e., less robust) drive shaft. Moreover, compared to other directional drilling devices, the embodiments of directional drilling sub 138 discussed below use fewer parts, which equates to less required inventory, reduced costs of machining, and reduced repair and/or maintenance time for servicing the directional drilling sub 138.

Figure 2A:
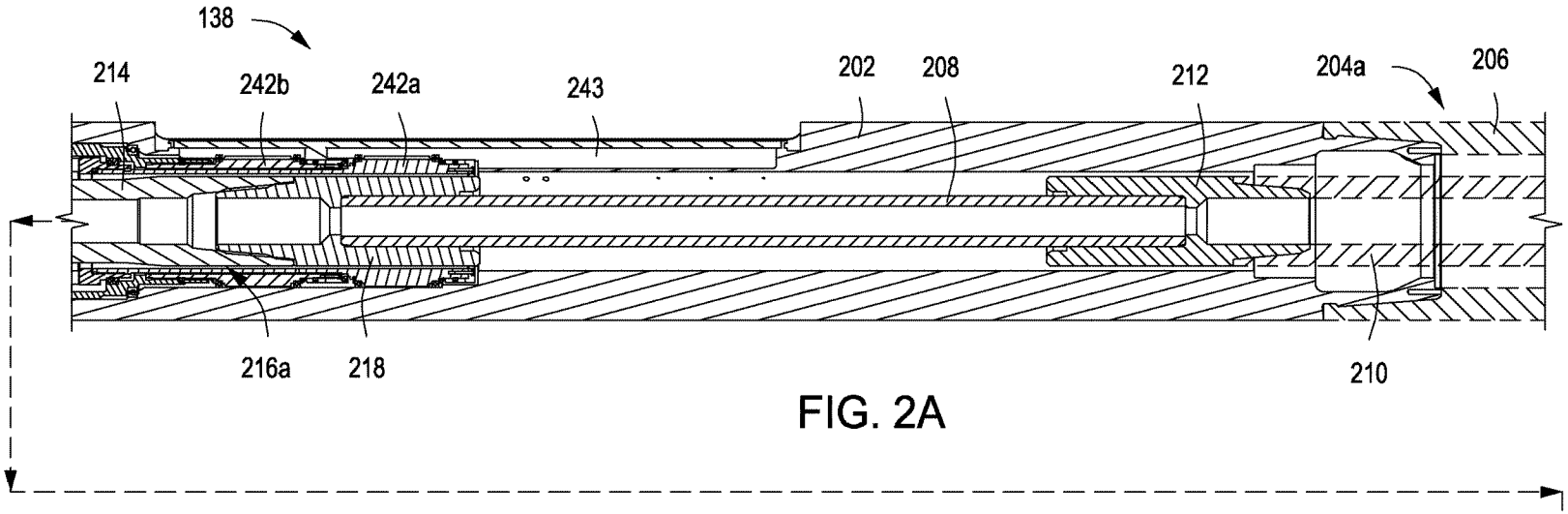
FIGS. 2A and 2B illustrate progressive cross-sectional side views of a portion of the directional drilling sub of FIG. 1, according to one or more embodiments.
Figure 2B:
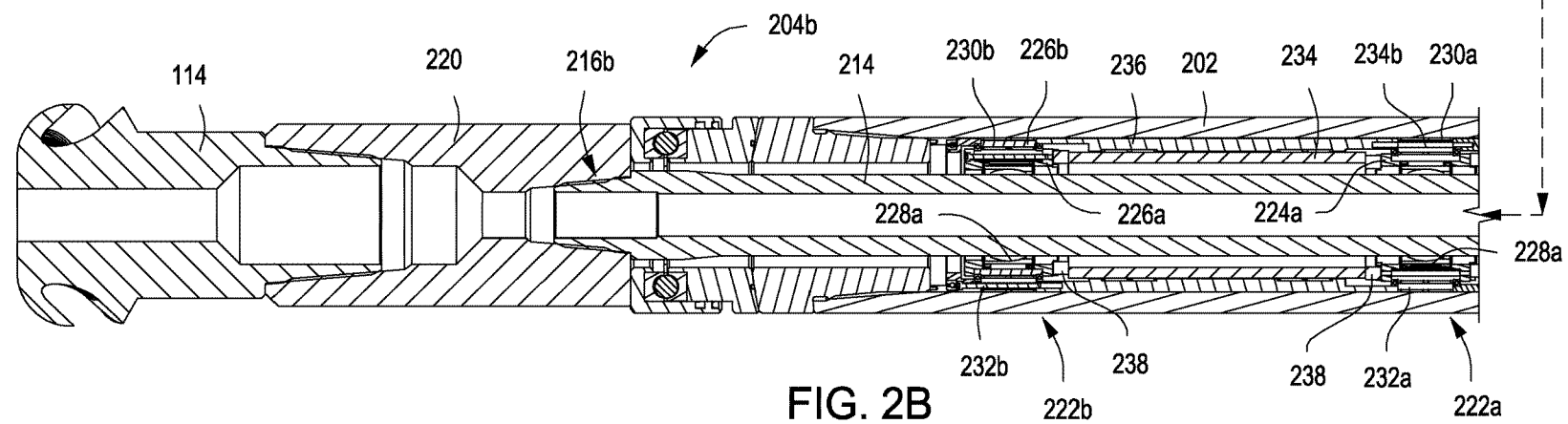

Referring now to FIGS. 2A and 2B, with continued reference to FIG. 1, illustrated are progressive cross-sectional side views of a portion of the directional drilling sub 138, according to one or more embodiments. More particularly, FIG. 2A depicts an upper or uphole end of the directional drilling sub 138, and FIG. 2B is an axial extension of FIG. 2A and depicts a lower or downhole end of the directional drilling sub 138. The use of directional terms such as above, below, upper, lower, upward, downward, left, right, uphole, downhole and the like are used in relation to the illustrative embodiments as they are depicted in the figures, the uphole or upper direction being toward the surface of the well and the downhole or lower direction being toward the toe or bottom of the well.

As illustrated, the directional drilling sub 138 may include a housing 202 that has a first or uphole end 204*a* and a second or downhole end 204*b*. The uphole end 204*a* of the housing 202 may be operatively coupled to a driver sub 206 (shown in dashed lines), which, in some embodiments, may house a mud motor (not shown) or other type of downhole drilling motor. The drill bit 114 may be arranged and otherwise located at or near the downhole end 204*b* of the housing 202.

The directional drilling sub 138 may further include a coupling mechanism 208. In some embodiments, as illustrated, the coupling mechanism 208 may be a torsional flex shaft that extends longitudinally within the housing 202. In other embodiments, however, the coupling mechanism 208 may also be, but is not limited to, a continuous velocity joint and/or a universal joint. At its uphole end, the coupling mechanism 208 may be operatively coupled to a drive shaft 210 (shown in dashed lines) that extends within or otherwise from the driver sub 206. The drive shaft 210 may be configured to transmit rotational energy in the form of torque to the coupling mechanism 208, which may ultimately be used to drive the drill bit 114. In embodiments where a mud motor is used, the uphole end of the drive shaft 210 may be operatively coupled to a rotor of the mud motor and rotated in response to drilling fluid circulating through the mud motor and thereby rotating the rotor. In other embodiments, the uphole end of the drive shaft 210 may be operatively coupled to (or otherwise form an integral part of) the drill string 108 (FIG. 1), which may be rotated from the drilling platform 102.

As illustrated, the coupling mechanism 208 may be coupled to the drive shaft 210 using a drive shaft coupling 212. In embodiments where the coupling mechanism 208 is a torsional flex shaft, the drive shaft coupling 212 may be a continuous velocity joint or the like. In other embodiments, the drive shaft coupling 212 may be any downhole threaded connection or coupling. In yet other embodiments, however, such as when the coupling mechanism 208 is a continuous velocity joint and/or a universal joint, as mentioned above, the drive shaft coupling 212 may be omitted and the coupling mechanism 208 itself may instead be coupled directly to the drive shaft 210.

The directional drilling sub 138 may also include a tilt drive shaft 214 that extends longitudinally within the housing 202 and has a first or uphole end 216*a* and a second or downhole end 216*b*. The tilt drive shaft 214 may be an operable extension of the drive shaft 210, such that rotation of the drive shaft 210 also rotates the tilt drive shaft 214. As discussed below, however, the tilt drive shaft 214 may be tiltable within the housing 202, and thereby able to adjust the azimuth tool face direction for the drill bit 114. As depicted, the tilt drive shaft 214 may be operatively coupled to the coupling mechanism 208 at its uphole end 216*a* using a drive shaft coupling 218. As will be appreciated, the coupling mechanism 208 may be configured to assume or otherwise bear any bending that may occur in the directional drilling sub 138 due to tilting of the tilt drive shaft 214. At its downhole end 216*b*, the tilt drive shaft 214 may be operatively coupled to the drill bit 114 using another drive shaft coupling 220. Similar to the drive shaft coupling 212, the drive shaft couplings 218 and 220 may be continuous velocity joints or the like.

As best seen in FIG. 2B, the tilt drive shaft 214 may be supported within the housing 202 with an upper eccentric assembly 222*a* and a lower eccentric assembly 222*b*. The upper and lower eccentric assemblies 222*a,b* are axially offset from each other along the axial length of the tilt drive shaft 214 and may be configured to tilt the tilt drive shaft 214 and thereby alter the axial deflection of the tilt drive shaft 214. To accomplish this, the upper and lower eccentric assemblies 222*a,b* may each include a pair of nested eccentric rings configured to rotate with respect to each other. More particularly, the upper eccentric assembly 222*a* may include an inner eccentric ring 224*a* nested within an outer eccentric ring 224*b*, and the lower eccentric assembly 222*b* may include an inner eccentric ring 226*a* nested within an outer eccentric ring 226*b*.

In order to allow the tilt drive shaft 214 to rotate freely without affecting the upper and lower eccentric assemblies 222*a,b*, corresponding radial bearings 228*a* and 228*b* may interpose the inner eccentric rings 224*a* and 226*a*, respectively, and the outer radial surface of the tilt drive shaft 214. Similarly, in order to allow the upper and lower eccentric assemblies 222*a,b* to rotate freely with respect to the housing 202, corresponding radial bearings 230*a* and 230*b* may be arranged between the outer eccentric rings 224*b* and 226*b*, respectively, and the inner wall of the housing 202. Moreover, corresponding radial bearings 232*a* and 232*b* may be arranged between the inner and outer eccentric rings 224*a,b* and 226*a,b*, respectively, in order to allow the inner and outer eccentric rings 224*a,b* and 226*a,b* of each eccentric assembly 222*a,b* to rotate with respect to each other. The radial bearings 228*a,b*, 230*a,b*, and 232*a,b* may be any type of radial bearing known to those skilled in the art including, but not limited to, needle roller bearings, four point contact ball bearings, angular contact bearings, plain bearings, and tapered bearings. In other embodiments, one or more of the radial bearings 228*a,b*, 230*a,b*, and 232*a,b* may be a fluid bearing, such as a hydrostatic bearing or the like.

The directional drilling sub 138 may further include an inner sleeve 234 and an outer sleeve 236 extending between the upper and lower eccentric assemblies 222*a,b*. More particularly, the inner sleeve 234 may be operatively coupled to and extend between the inner eccentric rings 224*a*, 226*a*, and the outer sleeve 236 may be operatively coupled to and extend between the outer eccentric rings 224*b*, 226*b*. The inner sleeve 234 may be configured to couple the inner eccentric rings 224*a*, 226*a* such that rotation of one correspondingly rotates the other. Likewise, the outer sleeve 236 may be configured to couple the outer eccentric rings 224*b*, 226*b* such that rotation of one correspondingly rotates the other. In some embodiments, corresponding couplings 238, such as Oldham couplings, may be used to operatively couple the inner and outer sleeves 234, 236 to the inner and outer eccentric rings 224*a,b* and 226*a,b*, respectively. As will be appreciated, however, other known types of couplings may be used, without departing from the scope of the disclosure.

In at least one embodiment, one or more radial coupler bearings 240 (only two are shown) may be arranged between the inner and outer sleeves 234, 236 and may be configured to allow the inner and outer sleeves 234, 236 to freely rotate with respect to each other during operation. Similar to the radial bearings 228*a,b*, 230*a,b*, and 232*a,b* discussed above, the radial coupler bearings 240 may include, but are not limited to, needle roller bearings, four point contact ball bearings, angular contact bearings, plain bearings, tapered bearings, and fluid bearings.

The inner sleeve 234 may be configured to couple the inner eccentric rings 224*a*, 226*a* such that they remain 180° out of phase with each other. Similarly, the outer sleeve 236 may be configured to couple the outer eccentric rings 224*b*, 226*b* such that they are also 180° out of phase with each other. In order to obtain a desired azimuth tool face direction for the drill bit 114, any one of the inner and outer eccentric rings 224*a,b* and 226*a,b* may be moved (i.e., rotated) and, in response thereto, the opposing eccentric ring will correspondingly move and may result in the tilt or "deflection" of the tilt drive shaft 214 with respect to the housing 202.

Rotating the inner and/or outer eccentric rings 224*a,b* and 226*a,b* may be accomplished using one or more drive motors, shown as a first drive motor 242*a* and a second drive motor 242*b*. The first and second drive motors 242*a,b*, may be any type of motor or device that is able to provide torque to the inner and outer eccentric rings 224*a,b* and 226*a,b*. In some embodiments, for example, one or both of the first and second drive motors 242*a,b* may be a brushless DC motor. In other embodiments, however, one or both of the first and second drive motors 242*a,b* may be a hydraulic or pneumatic motor, without departing from the scope of the disclosure.

In the illustrated embodiment, the first drive motor 242*a* may be operatively coupled to and configured to move the inner eccentric rings 224*a* and 226*a*. More particularly, the first drive motor 242*a* may be coupled to the upper inner eccentric ring 224*a* and thereby coupled to the lower inner eccentric ring 226*a* via the inner sleeve 234. In other embodiments, however, the first drive motor 242*a* may alternatively be arranged downhole from the eccentric assemblies 222*a,b* and coupled to the lower inner eccentric ring 226*a*, without departing from the scope of the disclosure.

Similarly, the second drive motor 242*b* may be operatively coupled to and configured to move the outer eccentric rings 224*b* and 226*b*. More particularly, as depicted in the illustrated embodiment, the second drive motor 242*b* may be coupled to the upper outer eccentric ring 224*b* and thereby coupled to the lower outer eccentric ring 226*b* via the outer sleeve 236. In other embodiments, however, the second drive motor 242*b* may alternatively be arranged downhole from the eccentric assemblies 222*a,b* and coupled to the lower outer eccentric ring 226*b*, without departing from the scope of the disclosure.

While not shown, in yet other embodiments, the inner and outer sleeves 234, 236 may be omitted and a dual output shaft may instead be installed between the upper and lower eccentric assemblies 222*a,b*. In such embodiments, a single or dual motor configuration may be used to drive the inner and outer eccentric rings 224*a,b* and 226*a,b*, thereby resulting in the desired tilt or "deflection" of the tilt drive shaft 214 with respect to the housing 202. In such embodiments, the inner and outer sleeves 234, 236 may be omitted, and thereby reducing the overall tool length of the tilt drive shaft 214 or the directional drilling sub 138. As will be appreciated, reducing the overall tool length may help to reduce torsional resonance issues. Moreover, in such embodiments, the single or dual motor configuration used to drive the inner and outer eccentric rings 224*a,b* and 226*a,b* may be an AC motor, a brushed DC motor, a piezo-electric motor, a stepper motor, an electronically commutated motor, a hydraulic drive, or a mini mud motor, without departing from the scope of the disclosure.

The directional drilling sub 138 may further include an electronics package 243 arranged on the housing 202. As illustrated, a portion of the housing 202 may be removed in order to provide access to the electronics package 243. The electronics package 243 may include several electronic components used to support the first and/or second drive motors 242*a,b*. For instance, the electronics package 243 may include a control module (not labeled) configured to control the first and/or second drive motors 242*a,b*, and thereby regulate the orientation of the inner and outer eccentric rings 224*a,b* and 226*a,b*. The electronics package 243 may further include a circuit power board (not labeled) having a memory and associated transceiver equipment used to communicate bi-laterally with, for example, the MWD tool 140 (FIG. 1) or an operator at a remote location (e.g., the drilling platform 102).

Electronics package 243 may also include sensors selected to collect desired data. For example, in some embodiments, the electronics package 243 may further include an at-bit-inclination sensor (not labeled) used to determine the real-time inclination of the drill bit 114, and the transceiver equipment may be used to communicate such data to the MWD tool 140 (FIG. 1). The electronics package 243 may also include a power supply (not labeled) used to power the electronics package 243, such as the first and second drive motors 242*a,b*. The power supply may be a battery or energy cell, but may also be a capacitor or alternator used to receive power from another source and provide that power to the directional drilling sub 138. Alternatively, the electronics package 243 may be powered from the surface using control lines (not shown).

Referring now to FIGS. 3-6, with continued reference to FIGS. 2A and 2B, illustrated are enlarged cross-sectional side views of a portion of the tilt drive shaft 214 during various exemplary phases of operation, according to one or more embodiments. In FIGS. 3-6, the inner and outer sleeves 234, 236 and the first and second motors 242*a,b* described above with reference to FIGS. 2A-2B have been omitted for clarity but would otherwise be included to operate as generally described above. As depicted, the tilt drive shaft 214 is supported within the housing 202 with the upper and lower eccentric assemblies 222*a,b*, including the inner and outer eccentric rings 224*a,b* and 226*a,b* and associated radial bearings 228*a,b*, 230*a,b*, and 232*a,b*.

A central axis 244 may be defined through the tilt drive shaft 214 and represents the central axis of the directional drilling sub 138 (FIGS. 2A-2B). When the tilt drive shaft is concentrically aligned within the housing 202 and otherwise not tilted or deflected, the central axis 244 may align with a rotational axis 245 for the tilt drive shaft 214. On the other hand, when the tilt drive shaft 214 is tilted or otherwise deflected, an angular offset is generated between the central axis 244 and the rotational axis 245 of the tilt drive shaft 214.

The tilt drive shaft 214 may include or otherwise exhibit a deflection focal point 246 located at a central location on the tilt drive shaft 214. With the tilt drive shaft 214 supported at or near each end with the upper and lower eccentric assemblies 222*a,b*, the deflection focal point 246 represents the location about which the tilt drive shaft 214 is tilted or deflects. Moreover, since the tilt drive shaft 214 is tilted about the deflection focal point 246, and not bent, the deflection focal point 246 remains generally stationary during operation.

Figure 3:
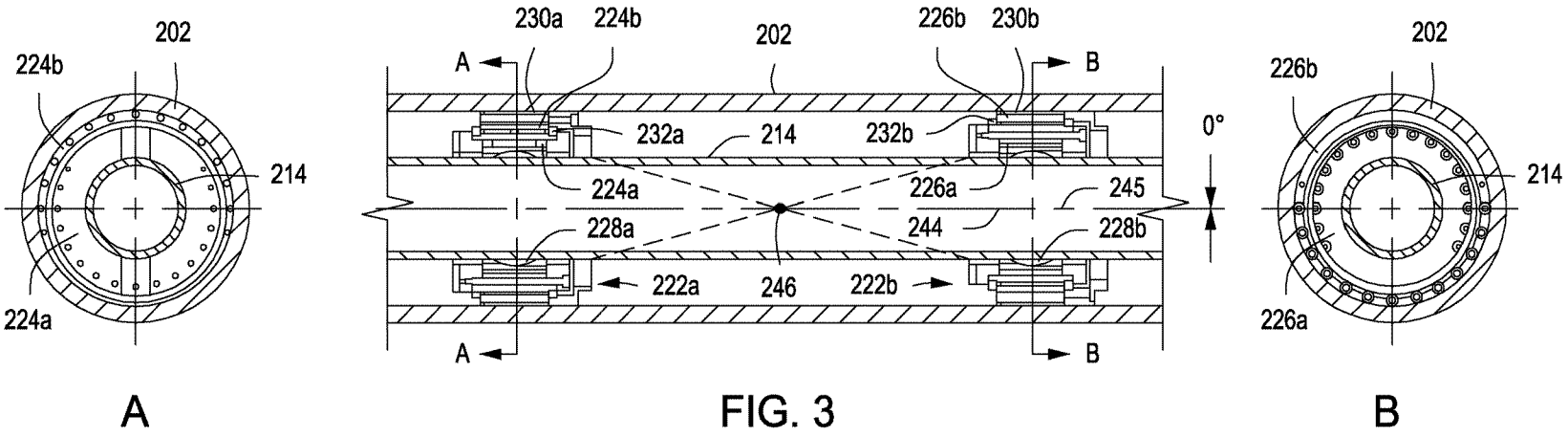
FIGS. 3-6 illustrate enlarged cross-sectional side views of a portion of the tilt drive shaft of FIGS. 2A-2B during exemplary phases of operation, according to one or more embodiments.

Referring specifically to FIG. 3, both the upper and lower eccentric assemblies 222*a,b* are depicted in a neutral configuration. In such a configuration, the upper and lower eccentric assemblies 222*a,b* are 180° out of phase with each other. As a result, the angular offset or deflection generated between the central axis 244 and the rotational axis 245 of the tilt drive shaft 214 is 0°. With no deflection occurring about the deflection focal point 246, the azimuthal tool face direction remains constant and drilling will proceed in the current direction.

Figure 4:
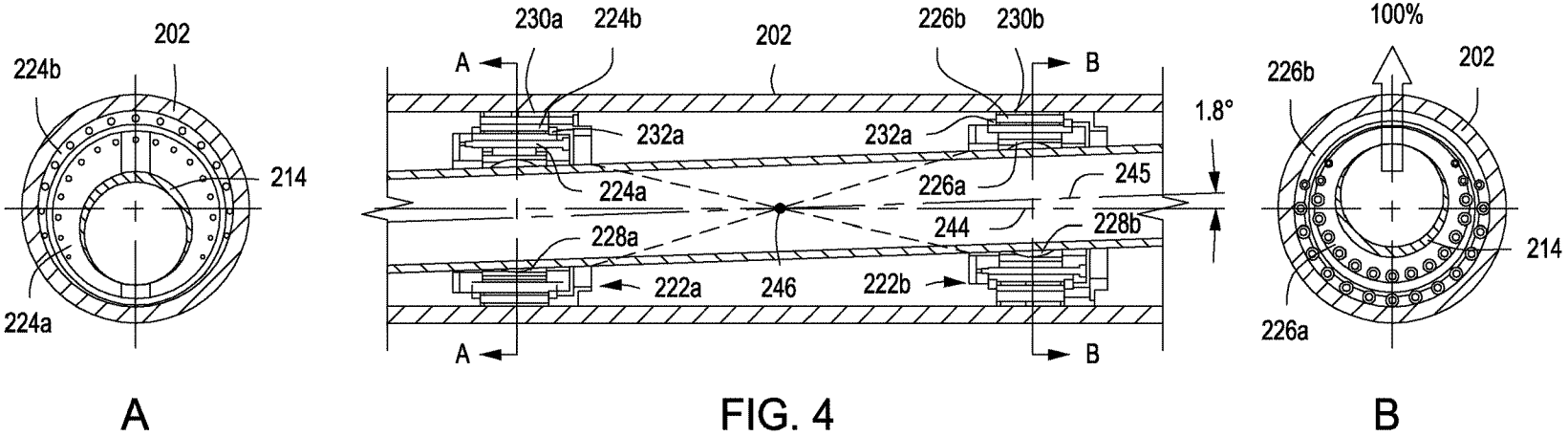

Referring now to FIG. 4, the tilt drive shaft 214 has been tilted about the deflection focal point 246, thereby resulting in an angular offset between the central axis 244 and the rotational axis 245 of 1.8°. In the illustrated embodiment, this can be accomplished by rotating the inner eccentric rings 224*a* and 226*a* 180° from the configuration depicted in FIG. 3. Alternatively, this can be accomplished by instead rotating the outer eccentric rings 224*b* and 226*b* 180° from the configuration depicted in FIG. 3. As indicated in the exemplary embodiment, a 1.8° angular offset from the central axis 244 results in a 100% deflection or tilt of the tilt drive shaft 214. In the depicted embodiment, a 100% deflection of the tilt drive shaft 214 will result in a 0° azimuthal tool face direction. As will be appreciated, in other embodiments where the tilt drive shaft 214 exhibits different dimensions or configurations, a larger or smaller angular offset than 1.8° may be required to achieve 100% deflection of the tilt drive shaft 214.

Accurately determining and/or controlling the tool face direction may be accomplished with the help of one or both of the first and second drive motors 242*a,b*. More particularly, brushless DC electric motors, such as electronically-commutated motors, commonly have a built-in feedback mechanism, such as a resolver or Hall Effect sensor. Such feedback mechanisms are able to track the position of the rotor relative to the stator in order to facilitate the motor operation. This feedback from both the drive motors 242*a,b* may prove useful in tracking and determining the tool face direction. In at least one embodiment, the resolver sensor feedback can be combined with a HET sensor that detects magnets (not shown) placed either on the inner and outer eccentric rings 224*a,b* and 226*a,b* or the sleeves 234, 236 (FIG. 2B). The numbers of magnets placed radially depends upon the resolution required to correct the tool face. For example, 16 magnets will give a resolution of 22.5 degrees, meaning the tool will be able to correct itself within this range.

Figure 5:
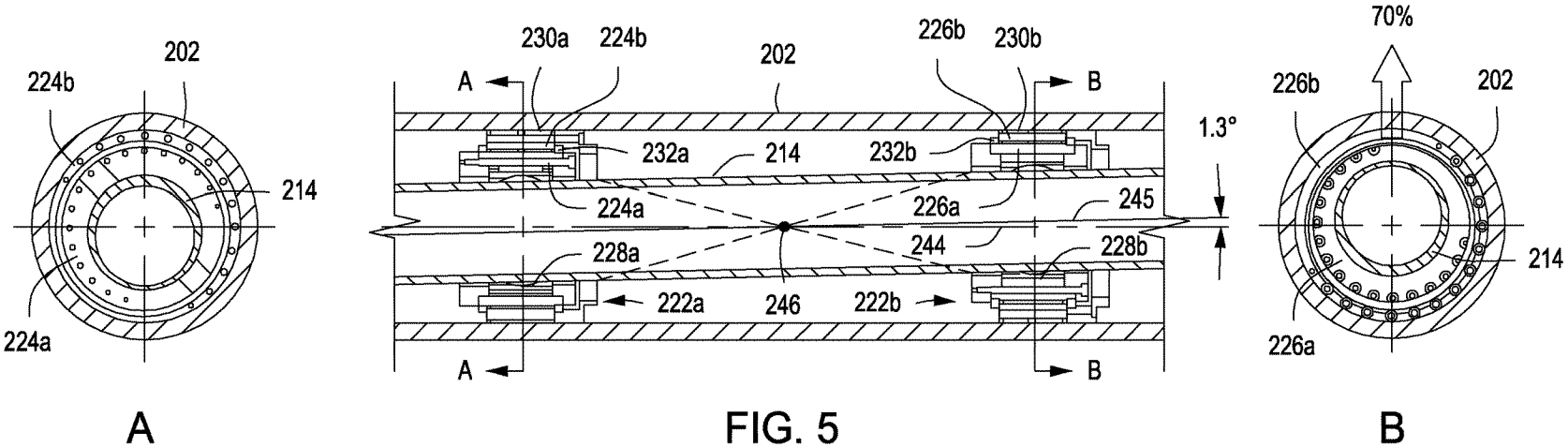

Referring now to FIG. 5, the tilt drive shaft 214 has again been tilted about the deflection focal point 246, and thereby resulting in an angular offset between the central axis 244 and the rotational axis 245 of 1.3°. In the illustrated embodiment, this can be accomplished by rotating the inner eccentric rings 224*a*, 226*a* 135° from 0° and also rotating the outer eccentric rings 224*b*, 226*b* 45° from 0°. Alternatively, this may equally be accomplished by rotating the outer eccentric rings 224*b*, 226*b* 135° from 0° and rotating the inner eccentric rings 224*a*, 226*a* 45° from 0°. In the depicted embodiment, a 1.3° angular offset from the central axis 244 results in a 70% deflection of the tilt drive shaft 214, which again results in a 0° azimuthal tool face direction or orientation.

Figure 6:
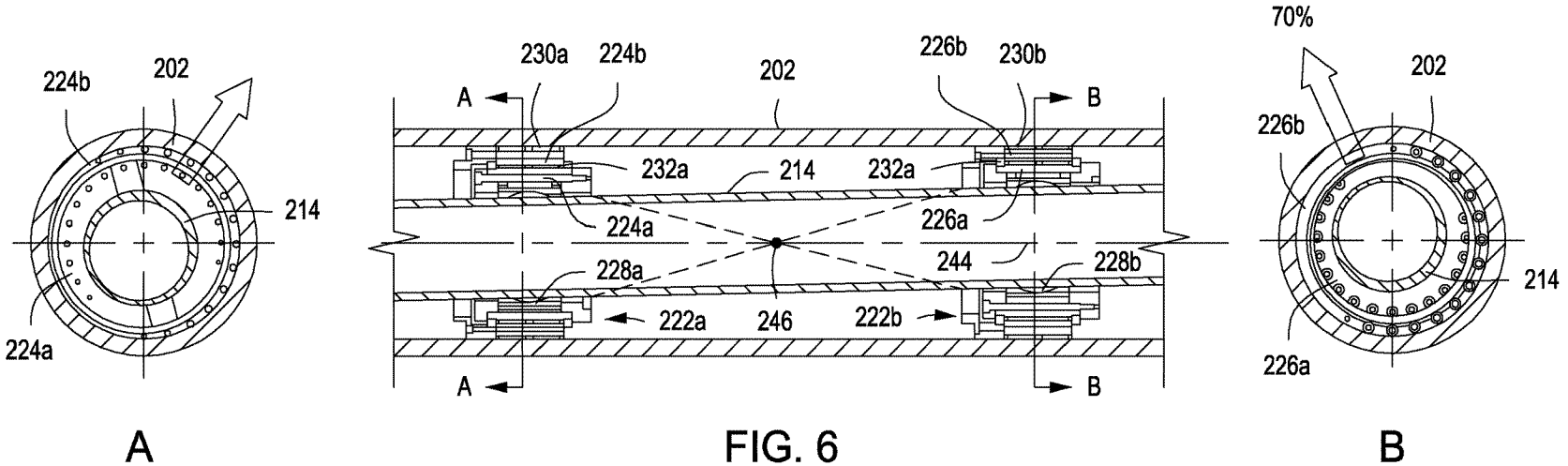

Referring now to FIG. 6, the tilt drive shaft 214 has again been tilted about the deflection focal point 246 by rotating the inner eccentric rings 224*a* and 226*a* 165° from 0° and also rotating the outer eccentric rings 224*b* and 226*b* 75° from 0°. As will be appreciated, this may equally be accomplished by rotating the outer eccentric rings 224*b* and 226*b* 165° from 0° and rotating the inner eccentric rings 224*a* and 226*a* 75° from 0°. Rotating the inner and outer eccentric rings 224*a,b* and 226*a,b* as such, may result in a 70% deflection of the tilt drive shaft 214, which translates into a 30° azimuthal tool face direction or orientation.

As will be appreciated, the embodiments shown above in FIGS. 3-6 are depicted merely for illustrative purposes and therefore should not be considered as limiting to the present disclosure. For example, in some embodiments, the configuration of the tilt drive shaft 214 and associated upper and lower eccentric assemblies 222*a,b* may allow angular offsets from the central axis 244 of no more than 1° or less to achieve the desired results. Those skilled in the art will readily appreciate the several different sizes and configurations that the directional drilling sub 138 (FIGS. 2A-2B) may assume, without departing from the scope of the disclosure.

Figure 7A:
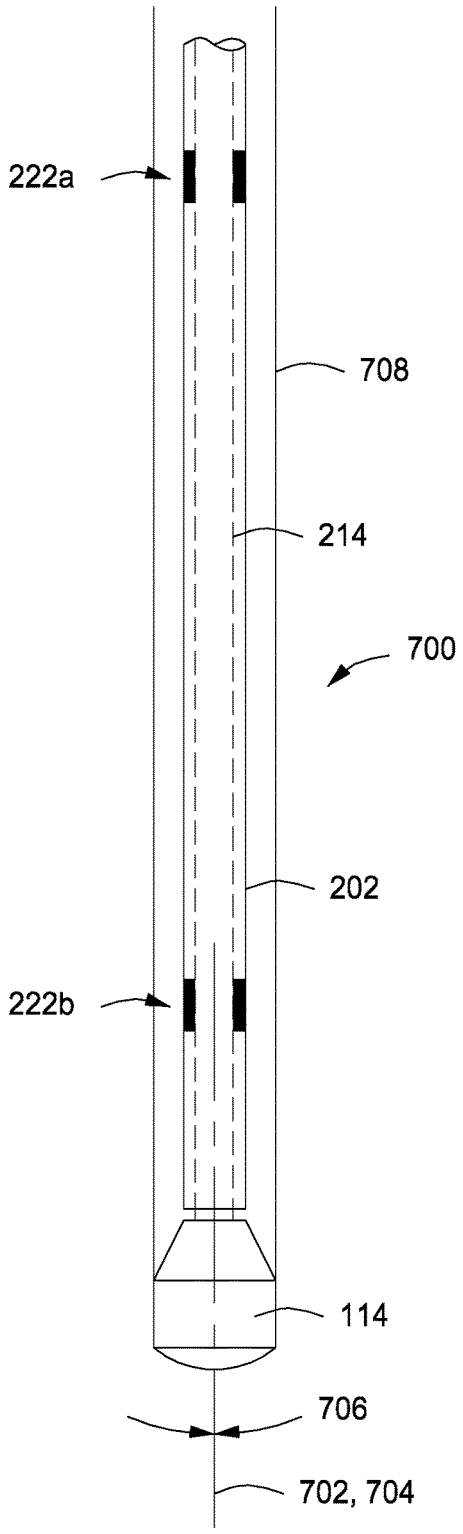
FIGS. 7A and 7B illustrate elevational views of an exemplary directional drilling sub, according to one or more embodiments.
Figure 7B:
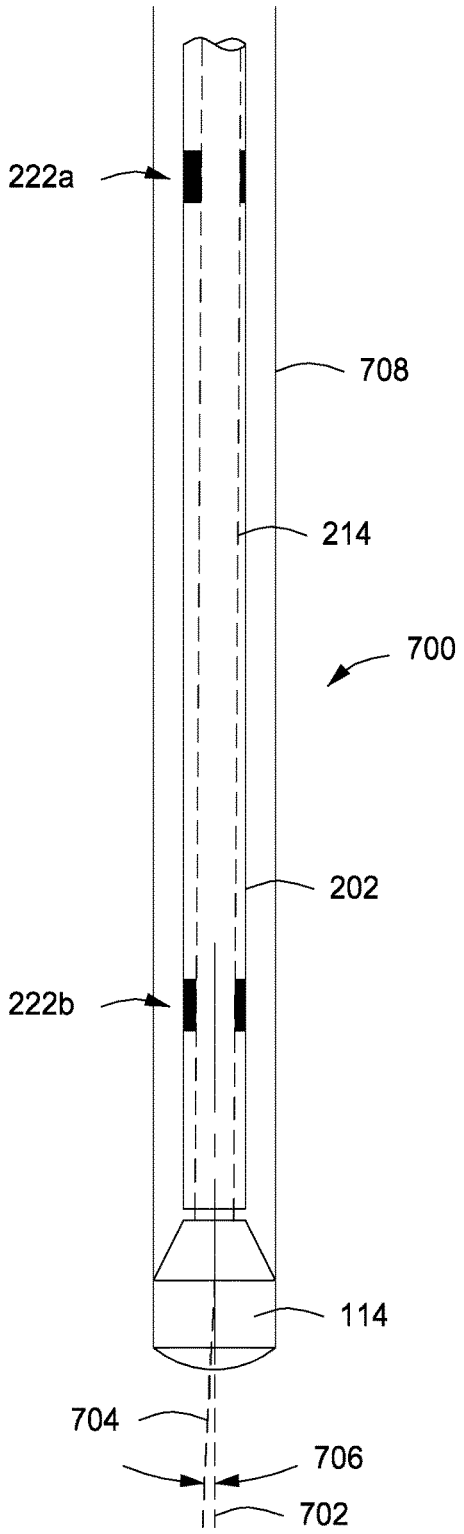

Referring now to FIGS. 7A and 7B, with continued reference to the foregoing figures, illustrated are elevational views of an exemplary directional drilling sub 700, according to one or more embodiments. The directional drilling sub 700 may be similar in some respects to the directional drilling sub 138 described above and therefore may be best understood with reference thereto, where like numerals represent like elements not described again in detail. The directional drilling sub 700 may be include the tilt drive shaft 214 (shown in dashed lines) rotatably supported within the housing 202 with the upper and lower eccentric assemblies 222*a* and 222*b*, as generally described above. The tilt drive shaft 214 may be operably coupled to the drill bit 114 at its distal end.

The directional drilling sub 700 may exhibit a central axis 702. When the tilt drive shaft 214 is concentrically aligned within the housing 202, and otherwise not tilted or deflected, the central axis 702 may generally align with a rotational axis 704 for the tilt drive shaft 214. On the other hand, when the tilt drive shaft 214 is tilted or otherwise deflected using the upper and lower eccentric assemblies 222*a,b*, an angular offset 706 may be generated between the central axis 702 and the rotational axis 704 of the tilt drive shaft 214.

As illustrated in FIGS. 7A and 7B, the directional drilling sub 700 may be used to control and otherwise alter the azimuthal tool face direction of the drill bit 114 while drilling a borehole 708. In FIG. 7A, the upper and lower eccentric assemblies 222*a,b* are depicted in a neutral configuration. More particularly, the upper and lower eccentric assemblies 222*a,b* are depicted in FIG. 7A as 180° out of phase with each other. As a result, the angular offset 706 or deflection generated between the central axis 702 and the rotational axis 704 of the tilt drive shaft 214 is 0°. Accordingly, the azimuthal tool face direction of the drill bit 114 remains constant and drilling will proceed in the current direction.

In FIG. 7B, however, the upper and lower eccentric assemblies 222*a,b* have been actuated, as generally described above, and the tilt drive shaft 214 has correspondingly been tilted within the housing 202 to generate the angular offset 706 between the central axis 702 and the rotational axis 704. The angular offset 706 may correspondingly alter the azimuthal tool face direction of the drill bit 114, such that the drill bit 114 may then proceed to cut the borehole 708 in a new direction proportional to the magnitude of the angular offset 706. The configuration of the tilt drive shaft 214 and associated upper and lower eccentric assemblies 222*a,b* may allow the angular offset 706 from the central axis 702 to achieve a maximum offset angle of about 1° in order to achieve the desired results. Those skilled in the art, however, will readily appreciate that other embodiments of the directional drilling sub 700 may allow offset angles greater than 1°, without departing from the scope of the disclosure.

Embodiments disclosed herein include:

A. A directional drilling sub that includes a housing, a tilt drive shaft extending longitudinally within the housing and having a first end configured to be operatively coupled to a coupling mechanism and a second end configured to be operatively coupled to a drill bit, an upper eccentric assembly arranged within the housing and configured to support the tilt drive shaft at or near the first end, the upper eccentric assembly including an upper inner eccentric ring nested within an upper outer eccentric ring and rotatable with respect to each other, and a lower eccentric assembly arranged within the housing and configured to support the tilt drive shaft at or near the second end, the lower eccentric assembly including a lower inner eccentric ring nested within a lower outer eccentric ring and rotatable with respect to each other, wherein rotational movement of at least one of the upper and lower inner or outer eccentric rings tilts the tilt drive shaft within the housing and thereby alters an azimuthal tool face orientation of the drill bit.

B. A method that includes introducing a directional drilling sub into a wellbore penetrating a subterranean formation, the directional drilling sub including a housing, a coupling mechanism arranged within the housing, and a tilt drive shaft extending longitudinally within the housing and having a first end operatively coupled to the coupling mechanism, drilling into the subterranean formation with a drill bit operatively coupled to a second end of the tilt drive shaft, supporting the tilt drive shaft within the housing at or near the first end with an upper eccentric assembly that includes an upper inner eccentric ring nested within an upper outer eccentric ring and being rotatable with respect to each other, supporting the tilt drive shaft within the housing at or near the second end with a lower eccentric assembly that includes a lower inner eccentric ring nested within a lower outer eccentric ring and being rotatable with respect to each other, and tilting the tilt drive shaft within the housing by rotating at least one of the upper and lower inner or outer eccentric rings and thereby altering an azimuthal tool face orientation of the drill bit.

Each of embodiments A and B may have one or more of the following additional elements in any combination: Element 1: wherein the housing has an uphole end coupled to a driver sub that houses a mud motor. Element 2: wherein the coupling mechanism is operatively coupled to a rotor of the mud motor. Element 3: wherein the coupling mechanism is at least one of a torsional flex shaft, a continuous velocity joint, and a universal joint. Element 4: wherein the tilt drive shaft is operatively coupled to at least one of the coupling mechanism and the drill bit with a continuous velocity joint. Element 5: further comprising a first radial bearing arranged between the upper inner eccentric ring and the upper outer eccentric ring, and a second radial bearing arranged between the lower inner eccentric ring and the lower outer eccentric ring. Element 6: further comprising an inner sleeve operatively coupled to and extending between the upper and lower inner eccentric rings such that rotation of one of the upper and lower inner eccentric rings correspondingly rotates the other, and an outer sleeve operatively coupled to and extending between the upper and lower outer eccentric rings such that rotation of one of the upper and lower outer eccentric rings correspondingly rotates the other. Element 7: wherein the upper and lower inner eccentric rings are 180° offset from each other and the upper and lower outer eccentric rings are 180° offset from each other. Element 8: further comprising a first drive motor operatively coupled to at least one of the upper and lower inner eccentric rings and configured to rotate the upper and lower inner eccentric rings, and a second drive motor operatively coupled to at least one of the upper and lower outer eccentric rings and configured to rotate the upper and lower outer eccentric rings. Element 9: an electronics package arranged on the housing and configured to control and provide power to the first and second drive motors. Element 10: further comprising at least one drive motor operatively coupled to at least one of the upper and lower eccentric assemblies and configured to rotate at least one of the upper and lower inner eccentric rings and the upper and lower outer eccentric rings.

Element 11: wherein tilting the tilt drive shaft within the housing comprises tilting the tilt drive shaft about a deflection focal point located at a central location on the tilt drive shaft between the upper and lower eccentric assemblies. Element 12: wherein the housing has an uphole end coupled to a driver sub that houses a mud motor, the method further comprising rotating a rotor of the mud motor with drilling fluid circulating through the mud motor, the coupling mechanism being operatively coupled to the rotor, and rotating the coupling mechanism in response to rotation of the rotor, whereby rotation of the coupling mechanism correspondingly rotates the tilt drive shaft. Element 13: wherein at least one drive motor is operatively coupled to at least one of the upper and lower eccentric assemblies, and wherein tilting the tilt drive shaft within the housing comprises rotating at least one of the upper and lower inner eccentric rings and the upper and lower outer eccentric rings with the at least one drive motor. Element 14: wherein a sleeve is operatively coupled to and extends between the at least one of the upper and lower inner eccentric rings and the upper and lower outer eccentric rings. Element 15: further comprising controlling the at least one drive motor with an electronics package arranged on the housing. Element 16: wherein the directional drilling sub further includes an inner sleeve operatively coupled to and extending between the upper and lower inner eccentric rings, and an outer sleeve operatively coupled to and extending between the upper and lower outer eccentric rings, the method further comprising rotating the upper and lower inner eccentric rings with a first drive motor operatively coupled to at least one of the upper and lower inner eccentric rings, and rotating the upper and lower outer eccentric rings with a second drive motor operatively coupled to at least one of the upper and lower outer eccentric rings. Element 17: wherein the upper and lower inner eccentric rings are 180° offset from each other. Element 18: wherein the upper and lower outer eccentric rings are 180° offset from each other. Element 19: further comprising controlling the first and second drive motors with an electronics package arranged on the housing.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A directional drilling sub, comprising:

a housing;

a tilt drive shaft extending longitudinally within the housing and having a first end configured to be operatively coupled to a downhole end of a coupling mechanism and a second end configured to be operatively coupled to a drill bit, wherein an uphole end of the coupling mechanism is coupled to a drive shaft, wherein the drive shaft is coupled to a drill string;

an upper eccentric assembly arranged within the housing and configured to support the tilt drive shaft at or near the first end, the upper eccentric assembly including an upper inner eccentric ring nested within an upper outer eccentric ring and rotatable with respect to each other; and a lower eccentric assembly arranged within the housing and configured to support the tilt drive shaft at or near the second end, the lower eccentric assembly including a lower inner eccentric ring nested within a lower outer eccentric ring and rotatable with respect to each other, wherein rotational movement of at least one of the upper and lower inner or outer eccentric rings tilts the tilt drive shaft within the housing and thereby alters an azimuthal tool face orientation of the drill bit.

2. The directional drilling sub of claim 1, wherein the housing has an uphole end coupled to a driver sub that houses a mud motor.

3. The directional drilling sub of claim 2, wherein the coupling mechanism is operatively coupled to a rotor of the mud motor.

4. The directional drilling sub of claim 3, wherein the coupling mechanism is at least one of a torsional flex shaft, a continuous velocity joint, and a universal joint.

5. The directional drilling sub of claim 1, wherein the tilt drive shaft is operatively coupled to at least one of the coupling mechanism and the drill bit with a continuous velocity joint.

6. The directional drilling sub of claim 1, further comprising:

a first radial bearing arranged between the upper inner eccentric ring and the upper outer eccentric ring; and a second radial bearing arranged between the lower inner eccentric ring and the lower outer eccentric ring.

7. The directional drilling sub of claim 1, further comprising:

an inner sleeve operatively coupled to and extending between the upper and lower inner eccentric rings such that rotation of one of the upper and lower inner eccentric rings correspondingly rotates the other; and an outer sleeve operatively coupled to and extending between the upper and lower outer eccentric rings such that rotation of one of the upper and lower outer eccentric rings correspondingly rotates the other.

8. The directional drilling sub of claim 7, wherein the upper and lower inner eccentric rings are 180° offset from each other and the upper and lower outer eccentric rings are 180° offset from each other.

9. The directional drilling sub of claim 7, further comprising:

a first drive motor operatively coupled to at least one of the upper and lower inner eccentric rings for rotating the upper and lower inner eccentric rings; and a second drive motor operatively coupled to at least one of the upper and lower outer eccentric rings for rotating the upper and lower outer eccentric rings.

10. The directional drilling sub of claim 9, an electronics package arranged on the housing and configured to control and provide power to the first and second drive motors.

11. The directional drilling sub of claim 1, further comprising at least one drive motor operatively coupled to at least one of the upper and lower eccentric assemblies and configured to rotate at least one of the upper and lower inner eccentric rings and the upper and lower outer eccentric rings.

12. A method, comprising:

introducing a directional drilling sub into a wellbore penetrating a subterranean formation, wherein the directional drilling sub comprises:

a housing, a coupling mechanism arranged within the housing, and a tilt drive shaft extending longitudinally within the housing and having a first end operatively coupled to a downhole end of the coupling mechanism, wherein an uphole end of the coupling mechanism is coupled to a drive shaft, wherein the drive shaft is coupled to a drill string;

drilling into the subterranean formation with a drill bit operatively coupled to a second end of the tilt drive shaft;

supporting the tilt drive shaft within the housing at or near the first end with an upper eccentric assembly that includes an upper inner eccentric ring nested within an upper outer eccentric ring and being rotatable with respect to each other;

supporting the tilt drive shaft within the housing at or near the second end with a lower eccentric assembly that includes a lower inner eccentric ring nested within a lower outer eccentric ring and being rotatable with respect to each other; and tilting the tilt drive shaft within the housing by rotating at least one of the upper and lower inner or outer eccentric rings and thereby altering an azimuthal tool face orientation of the drill bit.

13. The method of claim 12, wherein tilting the tilt drive shaft within the housing comprises tilting the tilt drive shaft about a deflection focal point located at a central location on the tilt drive shaft between the upper and lower eccentric assemblies.

14. The method of claim 12, wherein the housing has an uphole end coupled to a driver sub that houses a mud motor, the method further comprising:

rotating a rotor of the mud motor with drilling fluid circulating through the mud motor, the coupling mechanism being operatively coupled to the rotor; and rotating the coupling mechanism in response to rotation of the rotor, whereby rotation of the coupling mechanism correspondingly rotates the tilt drive shaft.

15. The method of claim 12, wherein at least one drive motor is operatively coupled to at least one of the upper and lower eccentric assemblies, and wherein tilting the tilt drive shaft within the housing comprises:

rotating at least one of the upper and lower inner eccentric rings and the upper and lower outer eccentric rings with the at least one drive motor.

16. The method of claim 15, wherein a sleeve is operatively coupled to and extends between the at least one of the upper and lower inner eccentric rings and the upper and lower outer eccentric rings.

17. The method of claim 15, further comprising controlling the at least one drive motor with an electronics package arranged on the housing.

18. The method of claim 12, wherein the directional drilling sub further includes an inner sleeve operatively coupled to and extending between the upper and lower inner eccentric rings, and an outer sleeve operatively coupled to and extending between the upper and lower outer eccentric rings, the method further comprising:

rotating the upper and lower inner eccentric rings with a first drive motor operatively coupled to at least one of the upper and lower inner eccentric rings; and rotating the upper and lower outer eccentric rings with a second drive motor operatively coupled to at least one of the upper and lower outer eccentric rings.

19. The method of claim 18, wherein the upper and lower inner eccentric rings are 180° offset from each other.

20. The method of claim 18, wherein the upper and lower outer eccentric rings are 180° offset from each other.

21. The method of claim 18, further comprising controlling the first and second drive motors with an electronics package arranged on the housing.

* * * * *